US006805578B2

(12) United States Patent
Chiou et al.

(10) Patent No.: US 6,805,578 B2
(45) Date of Patent: Oct. 19, 2004

(54) ELECTRICAL WIRING DEVICE

(75) Inventors: Yih-Chyuan Chiou, Wilmette, IL (US); Michael P. Mackin, Chicago, IL (US)

(73) Assignee: Woodhead Industries, Inc., Deerfield, IL (US)

( * ) Notice: Subject to any disclaimer, the term of this patent is extended or adjusted under 35 U.S.C. 154(b) by 0 days.

(21) Appl. No.: 10/389,664

(22) Filed: Mar. 14, 2003

(65) Prior Publication Data

US 2004/0180569 A1 Sep. 16, 2004

(51) Int. Cl.[7] ..... H01R 13/58
(52) U.S. Cl. ..... 439/469
(58) Field of Search ..... 439/469, 467, 439/321, 595, 695, 596, 686, 693, 318, 333, 462, 690, 697

(56) References Cited

U.S. PATENT DOCUMENTS

| | | | | |
|---|---|---|---|---|
| 3,784,961 A | | 1/1974 | Gartland, Jr. | |
| 4,080,036 A | | 3/1978 | Hagel | |
| 4,931,023 A | | 6/1990 | Browne | |
| 5,021,006 A | * | 6/1991 | Fargeaud et al. | 439/469 |
| 5,217,389 A | | 6/1993 | MacKay | |
| 5,304,075 A | | 4/1994 | Hoffman | |
| 5,328,387 A | * | 7/1994 | Hoffman | 439/469 |
| 5,338,222 A | | 8/1994 | Boteler | |
| 5,439,388 A | * | 8/1995 | Weiss et al. | 439/417 |
| 5,591,046 A | | 1/1997 | Klein | |
| 5,641,305 A | | 6/1997 | Lutz. | |
| 5,645,447 A | | 7/1997 | Sandor | |
| 5,743,759 A | | 4/1998 | Pudims | |
| 5,774,980 A | | 7/1998 | Klein | |
| D407,371 S | | 3/1999 | Pudims | |
| 5,885,099 A | | 3/1999 | Sandor | |
| 5,934,931 A | | 8/1999 | Castaldo | |
| 5,975,941 A | | 11/1999 | Castaldo | |
| 6,056,588 A | | 5/2000 | Castaldo | |
| 6,126,478 A | | 10/2000 | Presson | |

* cited by examiner

*Primary Examiner*—Ross Gushi
*Assistant Examiner*—Phuongchi Nguyen

(57) ABSTRACT

An electrical wiring device designed to be attachable to a cable in the field includes a housing which receives a core. Electrical contact elements (male or female) are carried by the core. At the rear of the housing, in an extension which receives the cable. The extension includes a series of spaced, truncated walls are formed in opposing relation to similar truncated walls formed in the clamp member. When the clamp is assembled to the housing extension, each pair of opposing truncated walls defines a cable-receiving aperture which is sized to clamp to a given range of cable sizes for strain relief. By reversing the clamp, the clamp-receiving apertures clamp to a different range of cable sizes while providing strain relief for the connections. The clamp also secures the core to the housing in either position of attachment.

11 Claims, 6 Drawing Sheets

ELECTRICAL WIRING DEVICE

FIELD OF THE INVENTION

The present invention relates to electrical wiring devices of the type which are used in industrial environments to provide connectors for electrical cables, and more particularly, to connectors which may be installed (i.e. attached to the wires of a cable) in the field, for example, to replace a defective or old connector.

BACKGROUND OF THE INVENTION

Electrical wiring devices (primarily electrical power connectors) designed to be attached to a cable in the field and of commercial or industrial quality are required to have some means for gripping the cable to prevent stress from being transmitted to the connection itself in the event a user inadvertently seeks to disconnect the device by pulling on the cable rather than the connector body, as is the proper way to disconnect.

It is also desirable that the connectors be capable of being attached to a range of cable sizes. For example, the same device may be designed to be attached to cables having three insulated conductors. Each of the three conductors may be wire of a range of gauge, including 12, 14, 16 and 18 gauge wire. The strain relief mechanism must, of course, be effective with the entire design range of these wire sizes and outer diameter of the cable.

Some current commercial wiring devices provide strain relief by using a shim or spacer, sometimes referred to as a "chicklet" which is inserted into the rear or cable end of the connector and used to adjust the size of a clamp opening to cables of smaller gauge wires, e.g. 16 and 18 gauge. Without the chicklet, the opening is sized to larger cables.

Another suggested approach disclosed in U.S. Pat. No. 5,304,075 includes a clamp attachable to an extension of a housing for a core, includes a series of concentric, spaced, closed cylindrical walls on the clamp in opposing relation to another series of cylindrical walls on the housing extension. The opposing cylindrical walls clamp down on the cable jacket to provide strain relief. Cables of a limited range of sizes may be accommodated.

Another aspect of present commercial electrical power connectors designed for installation in the field is that many use metal screws on the face of the core to secure it to the connector housing. The use of face screws to accomplish this purpose increases replacement time and adds cost to the product.

SUMMARY OF THE INVENTION

An electrical wiring device of the present of invention is intended to be attachable to the wires of a cable in the field and rugged enough to withstand the rigors of industrial applications, yet competitive in cost. The present wiring device includes a housing having a generally cylindrical front portion and a rear extension in the general form of a semi-cylinder. As used herein, "forward" or "distal" refers to the portion of a connector which is designed to attach to a mating connector; and the terms "rear" or "proximal" refer to the portion of the connector attached to the cable.

A core is received in the forward portion of the housing. The core carries electrical contact elements, male or female, according to the desired type of connector.

The housing extension receives a clamp member which provides two notable functions. First, it secures the wiring device to a cable providing strain relief for the connections between the wire conductors of the cable and the connector elements of the wiring device. The clamp of the instant invention also secures the core to the housing by means of positive, quick-connect coupling which avoids the use of screws, thus reducing cost and the time of replacement, and improving the appearance of the product.

A first series of truncated walls are formed in the clamp member. The truncated walls are generally straight; and they extend radially inwardly of the clamp member that is, transverse of an axis of the wiring device. A second series of spaced, truncated walls are formed in opposing relation to the truncated walls of the clamp member. The second series of walls is formed in the extension of the core. Each of the truncated walls has a central recess adapted to engage and compress the outer jacket of the cable.

When the clamp is assembled to the housing extension, the threadless quickconnect coupling secures the core to the housing. To accomplish this, the core is provided with a pair of rearwardly extending arms at the proximal ends of which there are apertures. The clamp member is provided with a pair of locating fingers at either end. As will be explained further within, the clamp is reversible in order to accommodate cables of different size. In either assembled state of the clamp, however, a forward pair of locator fingers are received in the rear apertures of the extension arms of the core to lock the core to the housing. This leaves the face of the core free of screw heads, reduces material cost and saves time installing connectors in the field.

Moreover, the opposing pairs of truncated walls are spaced such that the central recesses therein are sized to receive cables of different diameter.

For larger sized cables, the clamp is orientated in a direction that accommodates the pairs of truncated walls which cooperate to force the cable into a serpentine arrangement, bending and compressing the cable to secure it in strain relief relationship with the connector assemblies of the core. For smaller sized cable where the force against which strained relief protection is typically smaller, the clamp compresses the cable inwardly to effect two axially spaced gripping areas, each positively securing the cable to the core to provide strain relief.

Other features and advantages of the present invention will be apparent to persons skilled in the art from the following detailed description of the illustrated embodiment accompanied by the attached drawing wherein identical reference numerals refer to like parts in the various views.

DETAILED DESCRIPTION OF THE ILLUSTRATED EMBODIMENT

Figure 1:
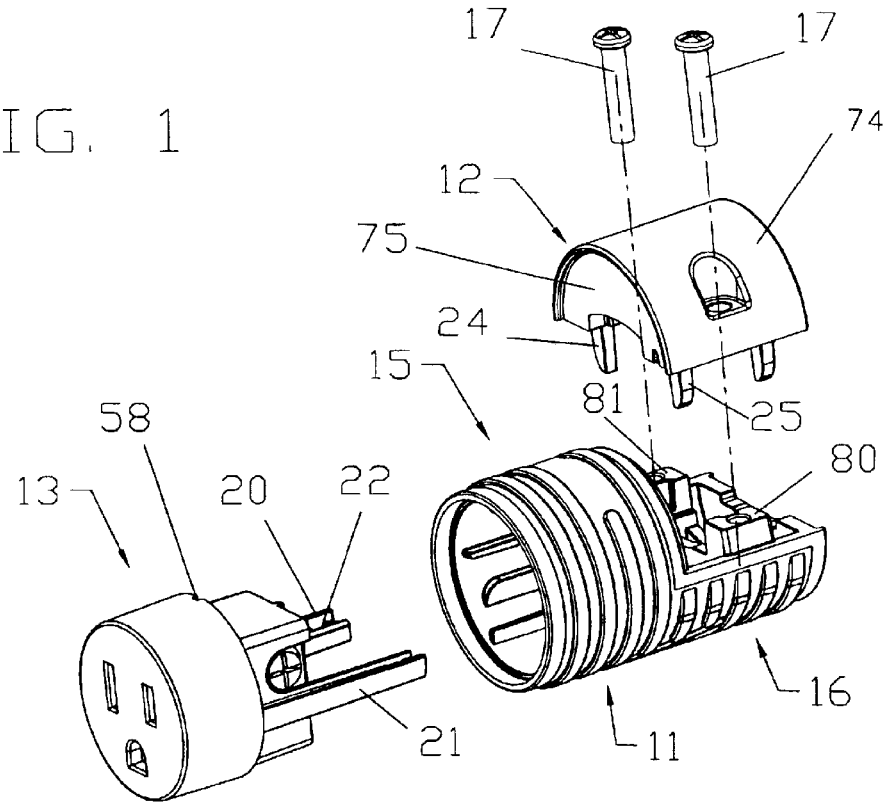
FIG. 1 is a perspective view taken from the front and side of the inventive wiring device or connector with the components of the new wiring device in exploded relation.
Figure 2:
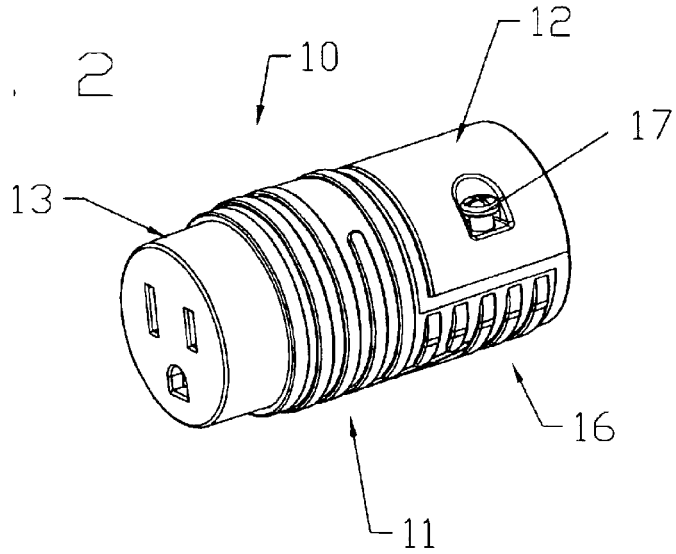
FIG. 2 is a side view of the wiring device of FIG. 1 with the components assembled.

Referring first to FIGS. 1 and 2, reference numeral 10 generally designates a wiring device having three principal component parts shown in exploded relation in FIG. 1, and including a housing generally designated 11, a clamp generally designated 12, and a core generally designated 13. The three major components are shown in assembled relation in side view in FIG. 2. As will be understood from subsequent description the clamp provides two principal functions. It secures the core to the housing in a threadless, quick-couple connection; and it cooperates with the core to provide affirmative strain relief for a range of cable sizes without the use of additional parts, such as the conventional chicklet.

In the embodiment of FIGS. 1 and 2, the core 13 is a female core—that is, as illustrated, it is designed to receive the male contact elements of a mating connector, such as the one illustrated in FIG. 4, and described subsequently.

Turning first to the housing 11, it includes a forward, generally cylindrical section 15 of closed sidewall, and a rear semi-cylindrical extension generally designated 16 to which the clamp member 12 is secured by a pair of threaded fasteners 17. As mentioned above, the terms "forward" or "distal" end of the wiring device relates to the connecting or mating end—that is toward the lower left in FIGS. 1 and 2; whereas the terms "rear" or "proximal" portion of the wiring device relates to the end which receives the cable—that is, toward the upper right portion of FIGS. 1 and 2.

Figure 6:
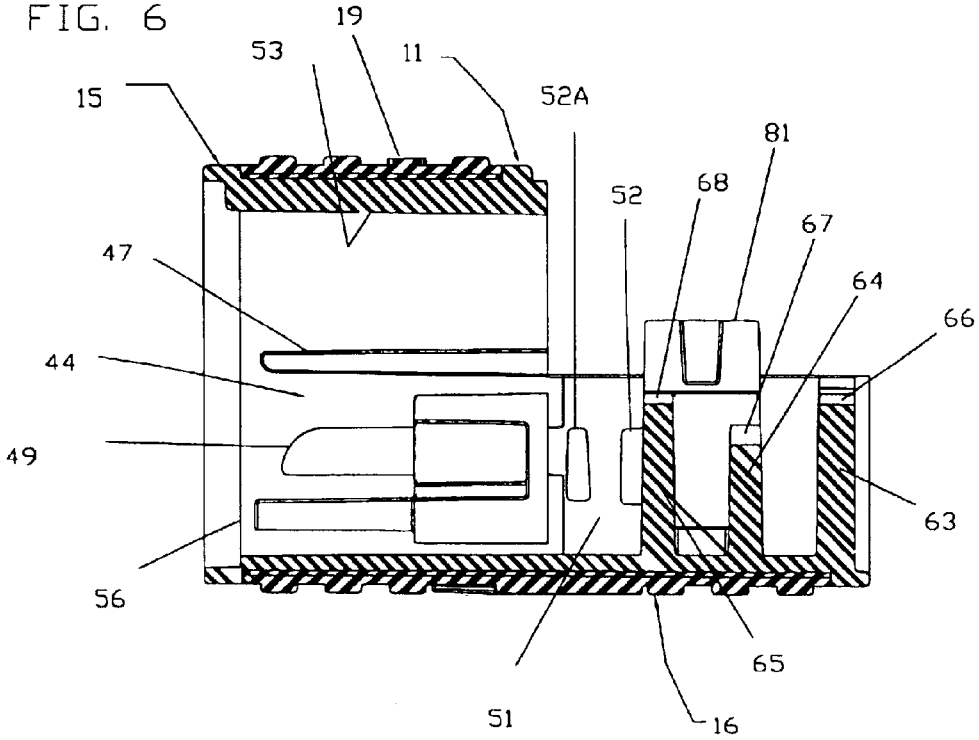
FIG. 6 is a vertical cross-sectional view taken through the site line 6—6 of FIG. 5.
Figure 7:
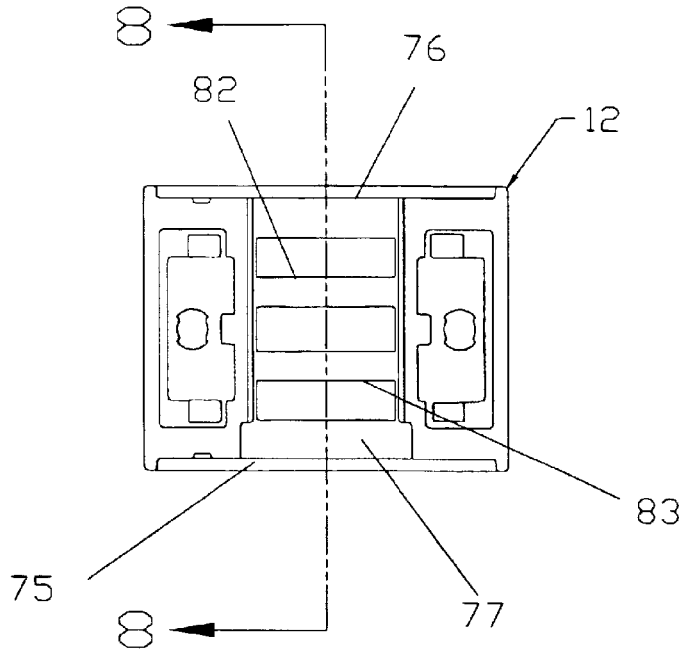
FIG. 7 is a bottom view of the clamp of the device of FIGS. 2 and 4.

Each of the components of the housing 11, clamp 12 and core 13, except for the connector assemblies received in the core 13 and to be described, may be molded using conventional techniques and insulating materials commonly found in wiring devices of this type; and the outer surface of the housing 11 may be covered with a rubber overmold 19 (FIG. 6). The overmold 19 improves grip and protects the underlying housing 11 from scratches and other damage.

Referring now to the core 13, it includes first and second (right and left looking in the forward or direction of connection) rearwardly-extending extension arms designated respectively 20 and 21 in FIG. 1. The right and left extension arms 20, 21 are integrally molded with the body of the core 13 as will be further described below; and they are received in slides and extend rearwardly through the forward, closed portion 15 of the housing 11 and into the forward portion of the rear extension 16 of the housing 11. The rear or proximal ends of the extension arms 20, 21 are provided respectively with threadless openings, one of which is seen at the far end of the right side of the extension arm 20 and designated 22 in FIG. 1. "Right" and "left" are taken to be the right and left side of the person located at the rear of the connector and looking toward the front of the connector, as those terms are defined above. As persons skilled in the art will appreciate, these conventions are used to facilitate a description of the structure of the invention, and play no part in the invention itself. Other conventions could equally well be employed.

These apertures at the rear of the extension arms 20, 21 receive a pair of correspondingly sized locator fingers molded integrally with the clamp 12, such as those designated 24, 25 in FIG. 1. Thus, when the clamp 12 is secured to the rear extension 16 of the housing 11, the locator fingers 24, 25 securely fix the core 13 to the housing 11 as well, as will be further described within. This structure which ties and fixes the core 13 to the housing 11 is significant in that it avoids the use, as notably exhibited in the prior art, of screws in the face of the insert for securing the core to the housing. That is, only two screws, not the customary four are used to secure both the strain relief and the core to the housing. It also facilitates assembly of the three major components of the connector.

Figure 3:
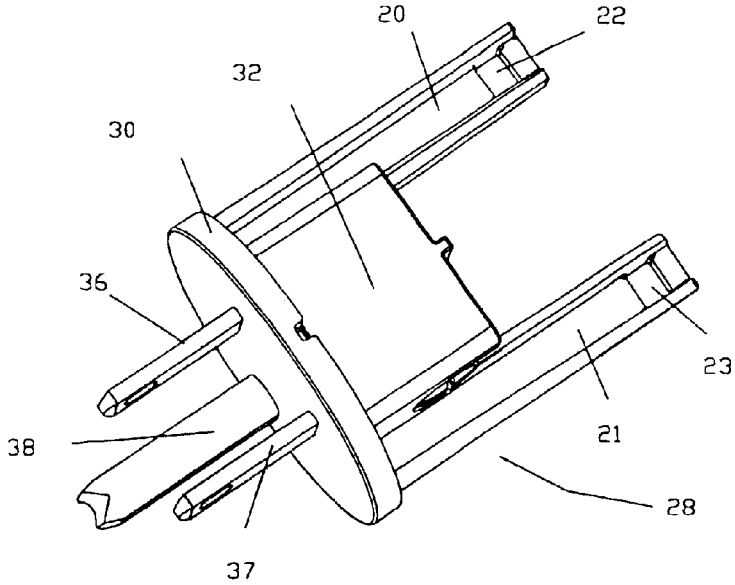
FIG. 3 is perspective view of a male core.
Figure 4:
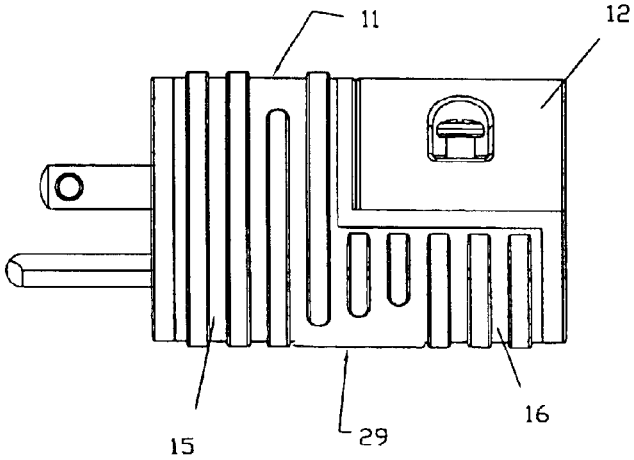
FIG. 4 is a side view of an assembled wiring device having male contact elements.

Turning now to FIGS. 3 and 4, there are shown perspective views of a male core generally designated 28 in FIG. 3, and in FIG. 4, the side view of the fully assembled male connector, generally designated 29. The core of the male and female connectors is different, as will be further described below. However, it is deemed to be an important advantage of the present invention that the same clamp 12 and housing 11 may be used to receive and secure interchangeable male and female cores. Thus, further description of the housing 11 and clamp 12 will continue to use reference numerals already identified.

Figure 3A:
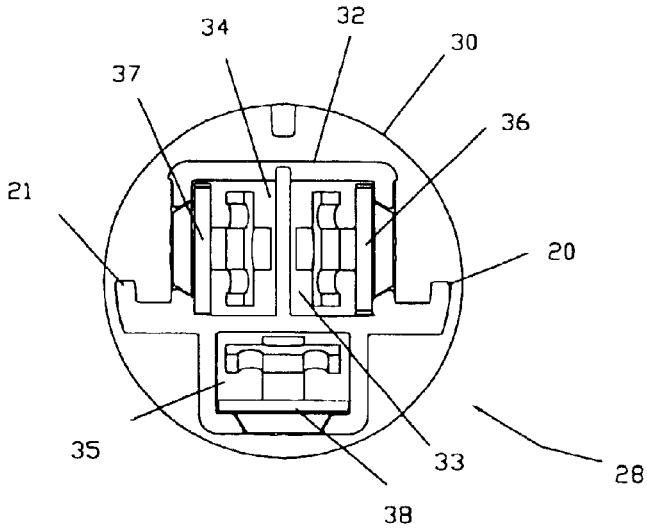
FIG. 3A is a rear view of a male core.

Turning now specifically to FIG. 3, the male core 28 includes a generally cylindrical face plate 30 to the back of which is molded a contact housing 32. The contact housing 32 (as best seen in FIG. 3A) includes three separate recesses designated respectively 33, 34 and 35 for receiving respectively the base of the contact assemblies for first and second blade contacts 36, 37 as well as a prong contact assembly 38 which conventionally provides ground contact.

Each of the contact assemblies 36–38 may be conventional and includes contact element having a base with an aperture through which a screw is placed. A flat, conductive nut is threaded onto the screw so that when the stripped end of a wire is inserted between the base of the contact and the nut, and the screw is turned, the nut forces the wire against the contact, thereby establishing electrical continuity between the wire and the contact element, as is known.

Figure 5:
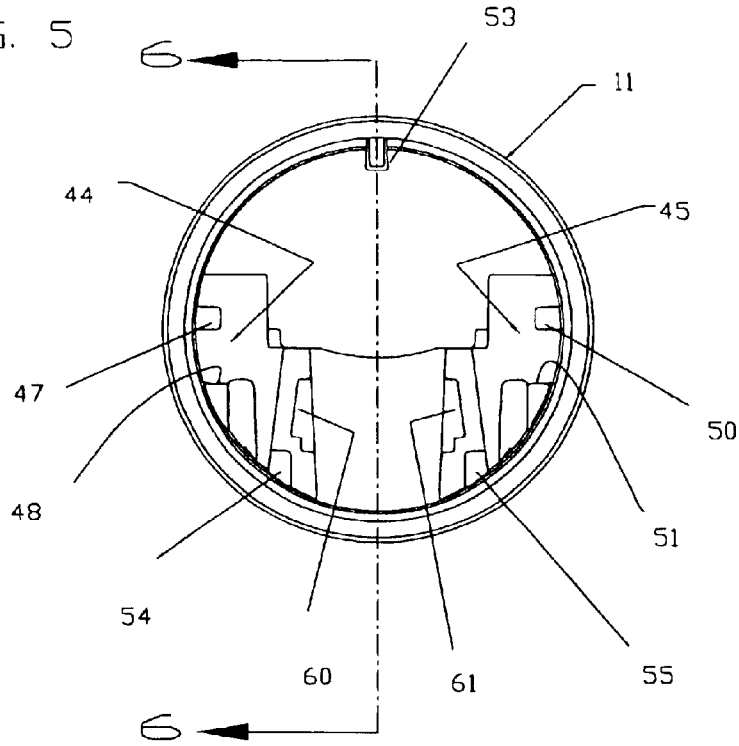
FIG. 5 is a front view of a housing for the devices of FIGS. 2 and 4.

Turning now to FIGS. 5 and 6, the interior of the housing 11 will be described. In the forward portion 15 of the housing 11, which has a completely closed circular sidewall as seen in FIG. 5, a pair of slides or ways generally designated respectively 44 and 45 are formed in opposing relationship. Each of the slides is located slightly below a horizontal plane and is adapted to slidingly receive, and to support one of the extension arms 20, 21 of the core 13. Each slide includes an upper rib 47 and a lower supporting ledge 48, the forward portion of which is curved as at 49 to guide the associated extension arm 20 into the slot 44 during assembly. A similar upper rib of 47 and lower ledge 48 form a slide 45 inside the forward portion 15 of the housing for receiving the left extension arm 21.

Behind each of the slides, and below an associated core extension arm 20, 21 when it is received in an associated slide, is a receptacle designated 51 in FIG. 6. Each receptacle is formed of two molded members 52, 52A. The receptacle 51 aligns with the aperture 22 of the extension arm 20 when the core is assembled to the housing. The receptacle 51 is positioned to receive the locking finger 24 of the clamp 12 when the clamp is assembled to the housing. Thus, the clamp secures the core and the housing together in a threadless, quick-coupling connection so that the core may be assembled to the housing without any separate fasteners directly securing the core to the housing, other than the fasteners 17 which secure the clamp to the housing. A similar receptacle is formed on the opposing side of the extension 16 to secure the second extension arm 21 of the core by means of locating fingers 25.

The core is further positioned and secured in the forward portion 15 of the housing 11 by three ribs designated 53, 54 and 55 in FIG. 5. The upper rib 53 extends forwardly of a peripheral shoulder 56 which seats the rear of the core; and it extends into a recess 58 formed in the back of the face of the core, for both male and female cores to positively locate the core. The other two ribs 54, 55 engage the rear surface of an associated core mounted to the housing to position it relative to the shoulder 56 for proper mounting.

Toward the rear of the ribs 54, 55, there are formed two partial walls 60, 61 which extend axially and are spaced in parallel array to permit access to the lower recess 35 of the contact housing 32 of the core to assemble the ground wire to the associated contact assembly. The partial walls 60, 61 also engage the rear, lateral walls of the contact housing 32 to limit the rearward motion of the core and properly position it within the housing.

It will be observed from FIG. 5 that by placing the slides 44, 45 asymmetrically to the forward portion 15 of the housing 11, extension arms 20, 21 must also be offset relative to the axis of the core to be properly received; and if the core is rotated 180 degrees on its axis, it cannot be properly assembled to the housing. Specifically, if one had the core turned upside down and the extension arms 20, 21 were initially aligned with the slides 44, 45, the contact housing 32 of the core would interfere with the forward peripheral edge of the forward portion 15 of the housing; and the core could not be received within the forward portion of the housing.

Turning now to the rear extension 16 of the housing, it includes an upright, truncated rear wall 63 an intermediate truncated wall 64 and a forward truncated wall 65. The wall 64, it will be observed, is adjacent the rear wall 63, and the wall 65 is remote from the rear wall 63. The walls 63–65 each defines an upper, central, curved recess, the recesses being designated 66, 67 and 68 respectively for the walls 63, 64 and 65.

The recesses 66, 67 and 68 are curved and sized to engage a range of cable sizes and to compress the jacket of each cable for the entire design range, as will be discussed. Each of the walls 63–65 is located, sized and arranged to cooperate with an opposing truncated wall formed on the interior of the clamp 12, to be discussed presently.

Turning now to FIGS. 7–10, the clamp member 12 will be described in more detail. As indicated above, the clamp 12 is reversible, one of the positions of the clamp 12 being shown in FIG. 1. Thus, the clamp does not have a "forward" or "rear" end since it may be used in one of two reversed positions. In the second of the two positions, locating fingers 24A, 25A, forming a second pair, are received in the receptacles such as 51 to secure the core to the housing.

The clamp 12 includes a cylindrical sidewall 74, and first and second end walls 75, 76. The clamp is secured to the extension 16 of the housing 11 by the fasteners 17 which are received in bores in formed pads or blocks 80, 81 of the extension 16, see FIGS. 1 and 6. Each of the end walls 75, 76 includes a central, curved recess, designated respectively 77 and 78 in FIGS. 8–10.

Figure 8:
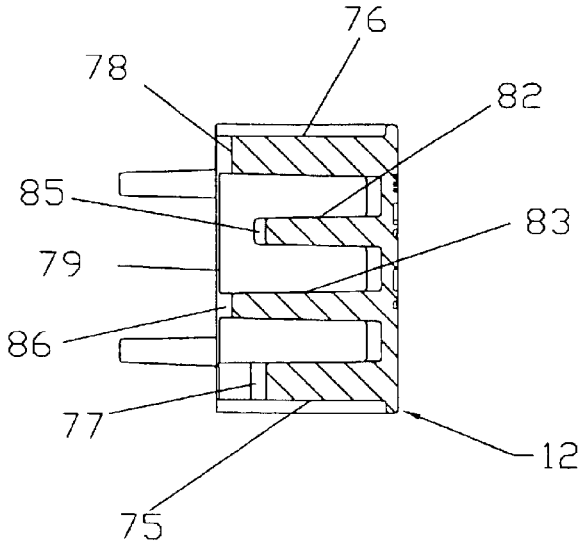
FIG. 8 is a vertical cross-sectional view taken through the site line 8—8 of FIG. 7.
Figure 9:
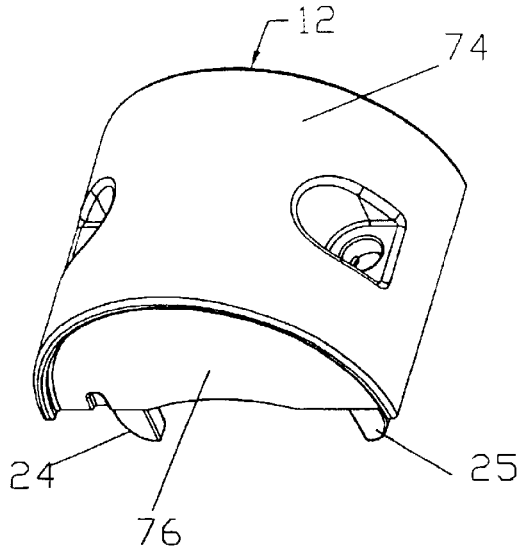
FIG. 9 is an upper perspective view of the clamp member.
Figure 10:
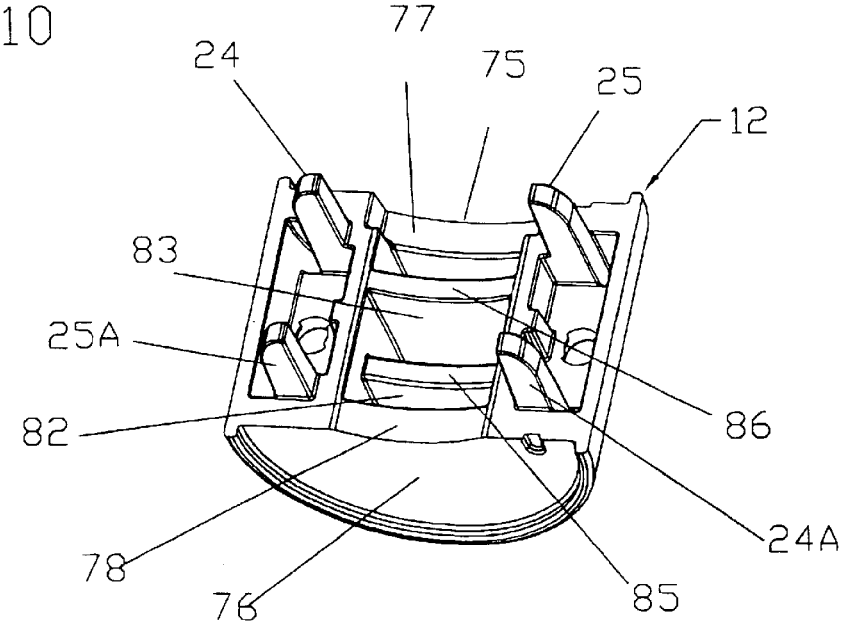
FIG. 10 is a bottom perspective view of the clamp member.

Referring to FIG. 8, the radially innermost portion of the clamp 12 defines a plane perpendicular to the plane of the page of FIG. 8 and generally designated 79. The plane 79 lies generally along the axis of the connector in its assembled position. It is useful to refer to the plane 79 to define the relative size of the recesses 77, 78, as well as recesses on two intermediate walls designated respectively 82 and 83 in FIG. 8, each of which also includes a central recess on the inner or truncated edge, the recesses being identified by reference numerals 85 and 86 respectively for the walls 82, 83.

Referring particularly to FIG. 8, the space defined by the recess 86 for the truncated intermediate wall 82 can be seen to be larger than the space defined by the recess 86 relative to the plane 79. Further, the recess 78 of end wall 76 is smaller, relative to the plane 79 than is the recess 77 of the first end wall 75.

Figure 11:
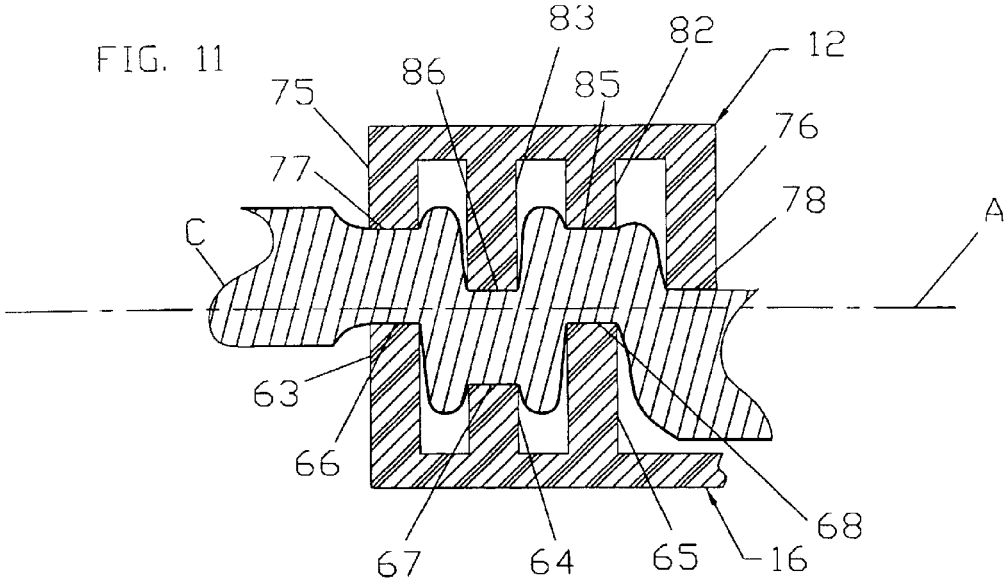
FIG. 11 is a vertical cross-sectional view of the clamp member and housing extension providing strain relief for a larger cable size.
Figure 12:
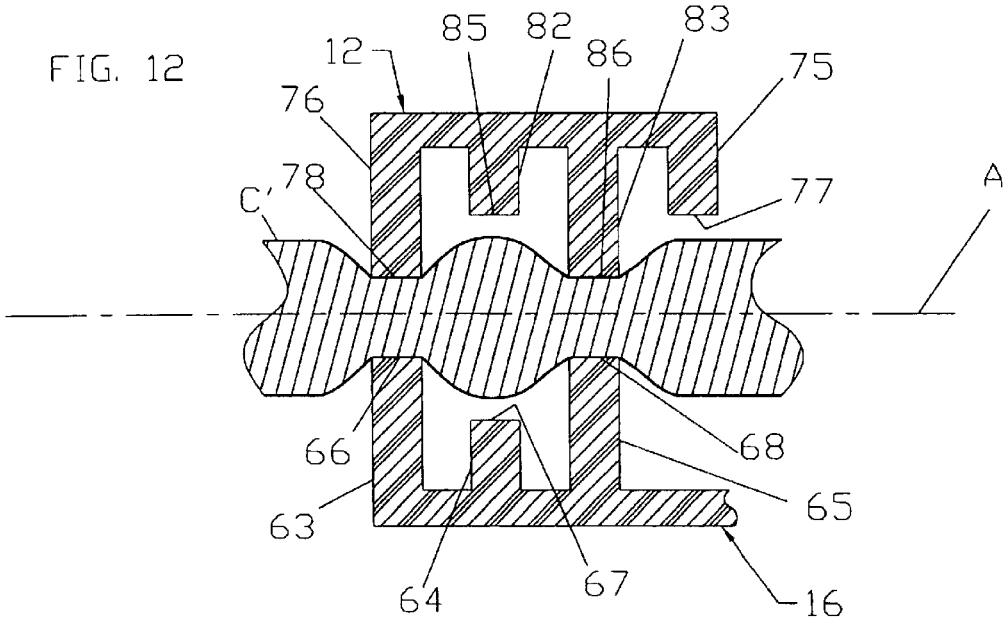
FIG. 12 is a view similar to FIG. 11 with the clamp in a reversed position and illustrating strain relief for a cable of a reduced diameter.

Turning now to FIGS. 11 and 12 for comparison, the extension 16 of the housing is shown in fragmentary form and in vertical section. In FIG. 11, the clamp 12 is shown in one position with the end wall 75 defining the larger recess 77 in a rear position. In FIG. 12, the clamp 12 has been reversed with the second end wall 76 having a smaller recess 78 in the rear position. It will be appreciated, first, that the intermediate truncated walls 82, 83 of the clamp 12 align with associated truncated walls 64, 65 of the extension 16 in opposing relation, whether the clamp is in the position of FIG. 11 or in the reverse position of FIG. 12, although the associated opposing walls are reversed also.

In FIG. 11, the cable, represented in idealized form and identified as C, is a larger cable than the cable C' in FIG. 12. For example, the cable C may contain three wires of twelve or fourteen gauge insulated wire, whereas the cable C' in FIG. 12 may include three insulated wires of eighteen or sixteen gauge.

When the clamp is arranged in the position of FIG. 11, the openings defined by the opposing walls are larger, but the three openings are uniform in size. Specifically, the recess 77 of the end wall 75 is larger than the recess 78 of the end wall 76 of the clamp 12, thus forming a larger opening, partially defined by the fixed end wall 63 of the extension 16 and its associated recess 66.

Similarly, the openings defined by the recesses of the opposing end walls 64 and 83 are approximately the same size as that defined by the end walls 75 and 63, described above. A third opening is defined by the recesses 68 and 85 respectively of truncated intermediate walls 65 of the extension 16 and 82 of the clamp 12. Thus, with the clamp in the position of FIG. 11 for larger cables, the cable C is forced into a serpentine arrangement with the centers of adjacent openings being radially offset relative to the axis A of the connector. In other words, the center of the first opening defined by the end wall 75, 63 is above the axis A as seen in FIG. 11. The center of the second opening defined by the wall 64 of the extension 16 and wall 83 of the clamp 12 is offset below axis A, forcing the cable C into a serpentine arrangement.

Further, it has been determined that the compression of a typical commercially available cable of the type used in the instant connector is such that the cable should be compressed approximately 50% of its normal, uncompressed original diameter. In this manner, the clamp in the first position shown in FIG. 11 provides a stable strain relief for larger cable sizes by both forcing the cable into the serpentine or multiple-bend configuration illustrated with each pair of opposing truncated walls uniformly compressing the cable at least thirty-five percent, and preferably about fifty percent. This causes the outer sheath of the cable C to bulge into the space between adjacent walls which further increases strain relief, thus mitigating any stress on the physical connections between the wires of the cable and the electrical contact assemblies described above.

For the smaller cable sizes of FIG. 12, the clamp 12 is reversed, and the end wall 76 of the clamp is located in opposing relation to the end wall 63 of the housing extension 16. The intermediate wall 83 of the clamp 12 is in opposing relation to the truncated wall 65 of the extension 16. The two pairs of opposing walls each define a smaller opening, again preferably providing, however, for a compression of at least about 50% of the original diameter of the cable. The operation of the structure of FIG. 12 is sufficient for cables of smaller diameter, even without the serpentine configuration of the cable C' due to this compression; and strain relief is provided to the connections between the wires and the contact assemblies in this case as well.

Having thus disclosed in detail the illustrated embodiment of the present invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

We claim:

1. An electrical connector adapted for attachment to a cable having a plurality of insulated conductors, comprising:

a core including a plurality of connector elements, each adapted to be connected to an associated conductor of said cable;

a housing having a generally cylindrical first portion receiving said core and an extension adapted to receive said cable, said extension including a first plurality of at least three interior truncated walls extending generally perpendicular to an axis of said housing and spaced along said axis, each of said first truncated walls having a free end, said first plurality of walls including a rear truncated wall defining a first recess, a central region of said first recess being spaced from an axis of said connector by a first distance; a second truncated wall spaced forwardly of said rear truncated wall and having a second recess with a central region thereof spaced further away from said axis than said first distance; and a third truncated wall spaced forwardly of said second truncated wall and having a recess with a central region spaced from the axis of said connector at approximately the same distance as said first distance to provide a serpentine path for said cable within said extension; and a clamp member adapted to be removably mounted to said extension of said housing and defining a second plurality of at least three truncated walls, each of said truncated walls of said clamp member aligning with an associated one of said first plurality of truncated walls of said extension when said clamp member is assembled to said housing and each truncated wall of said clamp member defining a free end adapted to receive and compress said cable in cooperation with an associated truncated wall of said first plurality of truncated walls of said housing extension when said clamp member is mounted to said housing extension and said cable is connected to said core.

2. The connector of claim 1 wherein said serpentine path in a plane perpendicular to said first truncated walls and perpendicular to said free ends of said first truncated walls.

3. The apparatus of claim 1 wherein said clamp defines four truncated walls and is characterized as being removably attachable to said extension in a first or a second reverse position, said opposing pairs of truncated walls defining three spaced first apertures for receiving and compressing a cable of relatively larger diameter when said clamp is assembled to said extension in said first position, said opposing pairs of truncated walls forcing a cable of larger diameter into a serpentine path for strain relief when said clamp is assembled to said extension in said first position, said opposing pairs of truncated walls defining at least two spaced second apertures of smaller size than said first apertures for receiving and compressing a cable of relatively smaller diameter when said clamp is assembled to said housing extension in said reverse position.

4. The apparatus of claim 3 wherein adjacent ones of first and second pluralities of truncated walls are spaced apart to define recesses, and wherein opposing pairs of truncated walls compress the outer diameter of said cable by at least about 40%, thereby forcing said cable to bulge in regions adjacent to said compression whereby said cable extends into said recesses between adjacent truncated walls.

5. The apparatus of claim 1 wherein said clamp includes four truncated walls including a first end wall having a recess with a central region at a second distance from said axis when said clamp is assembled to said housing; a first intermediate wall spaced inwardly of said first end wall and having a recess including a central region spaced from said axis at a distance greater than said second distance; a second end wall remote from said first end wall and having a recess having a central regional spaced from axis of said connector by a distance greater than said second distance; and a second intermediate wall spaced between said second end wall and said first intermediate wall and having a recess with a central region spaced from said axis of said connector at approximately said second distance.

6. The apparatus of claim 5 wherein said clamp member includes at least one fixing member located adjacent each of said end walls and extending inwardly of said extension when said clamp is assembled thereto said fixing member interlocking with said core to secure said core to said extension.

7. The apparatus of claim 6 wherein said clamp member includes a pair of elongated fixing members adjacent each of said end walls and said core includes first and second extension members extending through said closed portion of said housing and into said housing extension to receive one of said pairs of fixing members of said clamp, said fixing members coupling with said extension members and extending into sockets formed in alignment therewith within said extension members to fix said core to said housing when said clamp member is secured to said housing.

8. An electrical connector adapted for attachment to a cable comprising:

a core including a plurality of connector elements, each adapted to be connected to an associated conductor of said cable, said core including at least one member extending therefrom and defining an opening;

a housing receiving said core and including an extension adapted to receive a cable and including a first strain relief member, a clamp adapted to be mounted to said extension of said housing and including a locking member constructed to slidably insert in said opening of said one member of said core thereby to secure said core to said housing when said clamp is assembled to said housing, said clamp further including a second strain relief member cooperating with said first strain relief member to secure said cable to said housing.

9. The connector of claim 8 wherein said core includes a second member extending therefrom, said first and second members each defining an opening;

said housing defining first and second elongated slides for receiving said first and second members of said core and arranged to resist axial rotation of said core when assembled to said housing;

said clamp including a second locking member constructed to slidably insert in said opening of said second member of said core.

10. The connector of claim 9 wherein said first and second members of said core are axially elongated and each defines an opening, said first and second locking members of said clamp defining fingers slidingly received respectively in said first and second openings of said first and second members of said core.

11. An electrical connector adapted for attachment to a cable having a plurality of insulated conductors, comprising:

a core including a plurality of connector elements, each adapted to be connected to an associated conductor of said cable;

a housing having a generally cylindrical first portion receiving said core and an extension adapted to receive said cable, said extension including three interior truncated walls extending generally perpendicular to an axis of said housing and spaced along said axis, each of said truncated walls of said extension having a free end, adjacent ones of said free ends of said truncated walls of said extension terminating at different distances from said axis to provide a serpentine path for said cable adjacent said extension; and a clamp member adapted to be removably mounted to said extension of said housing and defining a plurality of truncated walls, at least two of said truncated walls of said clamp member aligning with associated ones of said truncated walls of said extension when said clamp member is assembled to said extension, and each truncated wall of said clamp member defining a free end adapted to receive and compress said cable in cooperation with an associated truncated wall of said extension when said clamp member is mounted to said extension in a first axial direction and said cable is connected to said core, and characterized in that said clamp is attachable to said extension in said first axial direction, or a second, reverse axial direction, said opposing pairs of truncated walls defining three spaced relatively larger first apertures for receiving and compressing a cable of relatively larger size when said clamp is assembled to said extension in said first axial direction, said opposing pairs of truncated walls forcing a cable of larger diameter into a serpentine path for strain relief when said clamp is assembled to said extension in said first axial direction, said opposing pairs of truncated walls defining at least two spaced apertures of smaller size than said first apertures for receiving and compressing a cable of relatively smaller diameter when said clamp is assembled to said housing extension in a second, reverse axial direction.

* * * * *